US006764160B1

(12) United States Patent
Phillips et al.

(10) Patent No.: US 6,764,160 B1
(45) Date of Patent: Jul. 20, 2004

(54) PRINTHEAD INTERPOSING MAINTENANCE APPARATUS AND METHOD AND IMAGE PRODUCING MACHINE HAVING SAME

(75) Inventors: Scott J. Phillips, W. Henrietta, NY (US); Elliott A. Eklund, Penfield, NY (US); Roger Leighton, Rochester, NY (US); John Murphy, Webster, NY (US); Ronald L. Nichols, Webster, NY (US); Donald J. Drake, Rochester, NY (US); Antonio L. Williams, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/320,826

(22) Filed: Dec. 16, 2002

(51) Int. Cl.[7] ..... B41J 2/165

(52) U.S. Cl. ..... 347/32; 347/29; 347/30; 347/33

(58) Field of Search ..... 347/22, 29, 30, 347/32, 33

(56) References Cited

U.S. PATENT DOCUMENTS

| | | | | |
|---|---|---|---|---|
| 4,636,803 A | | 1/1987 | Mikalsen | 346/1.1 |
| 4,739,339 A | | 4/1988 | DeYoung et al. | 346/1.1 |
| 5,038,157 A | | 8/1991 | Howard | 346/140 R |
| 5,372,852 A | | 12/1994 | Titterington et al. | 427/288 |
| 5,493,319 A | * | 2/1996 | Hirabayashi et al. | 347/29 |
| 6,053,608 A | | 4/2000 | Ishii et al. | 347/88 |
| 6,293,648 B1 | * | 9/2001 | Anderson | 347/29 |
| D453,787 S | | 2/2002 | Mattern | D18/56 |

* cited by examiner

*Primary Examiner*—Shih-Wen Hsieh
(74) *Attorney, Agent, or Firm*—Tallam I. Nguti

(57) ABSTRACT

A printhead interposing maintenance method and apparatus are provided for maintaining a printhead assembly within a relatively tight space in an image producing machine. The printhead interposing maintenance apparatus for the method includes (a) at least a first home position adjacent a first side of four sides of an operating zone between a printhead assembly and an imaging surface in the image producing machine; (b) a first moving device for moving the printhead assembly from a printing first position adjacent the imaging surface to a maintaining second position spaced further away from the printing first position; (c) a maintenance apparatus movably supported for movement along an maintenance path interposed between the imaging surface and the printhead assembly; (d) a second moving device for moving the maintenance apparatus for contacting and maintaining the printhead assembly, and along the maintenance path from the at least first home position to a resting position adjacent a second side and opposite the first side of the four sides of the operating zone; and (e) a third moving device for moving the printhead assembly back from the maintaining second position to the printing first position.

22 Claims, 4 Drawing Sheets

PRINTHEAD INTERPOSING MAINTENANCE APPARATUS AND METHOD AND IMAGE PRODUCING MACHINE HAVING SAME

RELATED CASE

This application is related to U.S. application Ser. No. 10/320,818 entitled "Phase Change Waste Ink Control Apparatus And Method" filed on even date herewith, and having at least one common inventor.

BACKGROUND OF THE INVENTION

This invention relates generally to image producing machines such as copiers, printers, facsimile machines and the like which use marking material delivery printheads, and more particularly to a printhead interposing maintenance apparatus and method for use therein to commonly clean a printhead assembly. The printhead interposing maintenance apparatus and method for example is disclosed in a phase change ink image producing machine or printer using same.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

Conventionally, the solid form of the phase change is a "stick", "block", "bar" or "pellet" as disclosed for example in U.S. Pat. No. 4,636,803 (rectangular block 24, cylindrical block 224); U.S. Pat. No. 4,739,339 (cylindrical block 22); U.S. Pat. No. 5,038,157 (hexagonal bar 12); U.S. Pat. No. 6,053,608 (tapered lock with a stepped configuration). Further examples of such solid forms are also disclosed in design patents such as U.S. Des. Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Conventionally, phase change ink image producing machines or printers, particularly color image producing such machines or printers, are considered to be low throughput, typically producing at a rate of less than 30 prints per minute (PPM). The throughput rate (PPM) of each phase change ink image producing machine or printer employing solid phase change inks in such "stick", "block", "bar" or "pellet" forms is directly dependent on how quickly such a "stick", "block", "bar" or "pellet" form can be melted down into a liquid. The quality of the images produced depends on such a melting rate, and on the types and functions of other subsystems employed to treat and control the phase change ink as solid and liquid, the imaging member and its surface, the printheads, and the image receiving substrates.

There is therefore a need for a relatively high-speed (greater than "XX" PPM) phase change ink image producing machine or printer that is also capable of producing relatively high quality images, particularly color images on plain paper substrates.

SUMMARY OF THE INVENTION

In accordance with the present invention, there is provided a printhead interposing maintenance method and apparatus are provided for maintaining a printhead assembly within a relatively tight space in an image producing machine. The printhead interposing maintenance apparatus for the method includes (a) at least a first home position adjacent a first side of four sides of an operating zone between a printhead assembly and an imaging surface in the image producing machine; (b) a first moving device for moving the printhead assembly from a printing first position adjacent the imaging surface to a maintaining second position spaced further away from the printing first position; (c) a maintenance apparatus movably supported for movement along an maintenance path interposed between the imaging surface and the printhead assembly; (d) a second moving device for moving the maintenance apparatus for contacting and maintaining the printhead assembly, and along the maintenance path from the at least first home position to a resting position adjacent a second side and opposite the first side of the four sides of the operating zone; and (e) a third moving device for moving the printhead assembly back from the maintaining second position to the printing first position.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
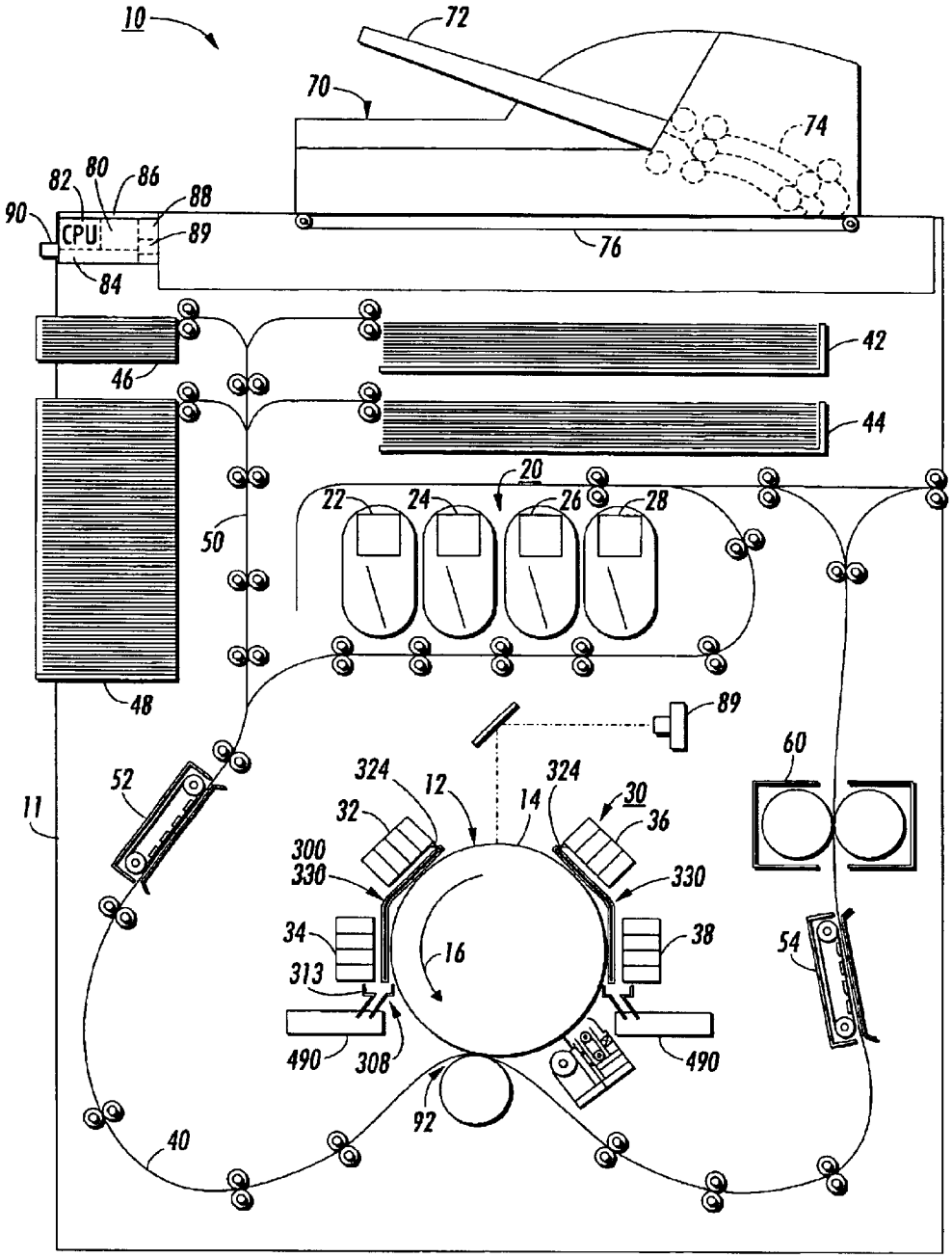
FIG. 1 is a vertical schematic of an image producing machine in the form of an exemplary phase change ink image producing machine including the printhead interposing maintenance apparatus and method of the present invention.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown in FIG. 1) for melting or phase changing the solid form of the phase change ink into a liquid form. The phase change ink delivery system is suitable for then supplying the liquid form to a printhead system 30 including at least one printhead assembly 32. Since the phase change ink image producing machine or printer 10 is a high-speed, or high throughput, multicolor image producing machine, the printhead system 30 includes multicolor ink printhead assemblies and a plural number (e.g. four (4)) of separate printhead assemblies 32, 34, 36 and 38 as shown. In order to achieve and maintain relatively high quality image productions by the printhead assembly, the machine 10 includes the printhead interposing maintenance apparatus and method 300, 330 of the present invention (to be described in detail below).

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including timing and operation of the printhead interposing maintenance apparatus and method 300, 330 of the present invention.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60. As discussed above, as programmed, the printhead interposing maintenance apparatus and method 300, 330 of the present invention function to clean the printhead assembly in order to achieve and maintain image quality.

Figure 2:
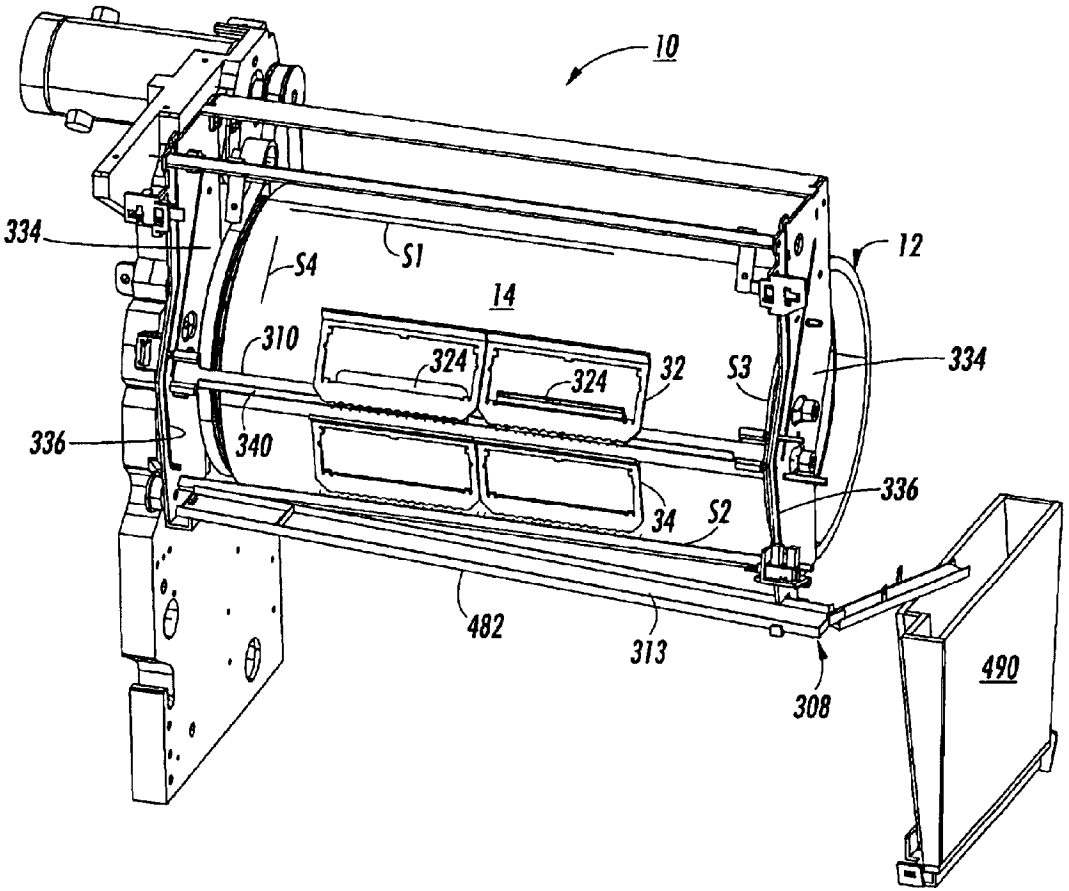
FIG. 2 is a perspective illustration of the printhead interposing maintenance apparatus and method as employed in the machine of FIG. 1.
Figure 3:
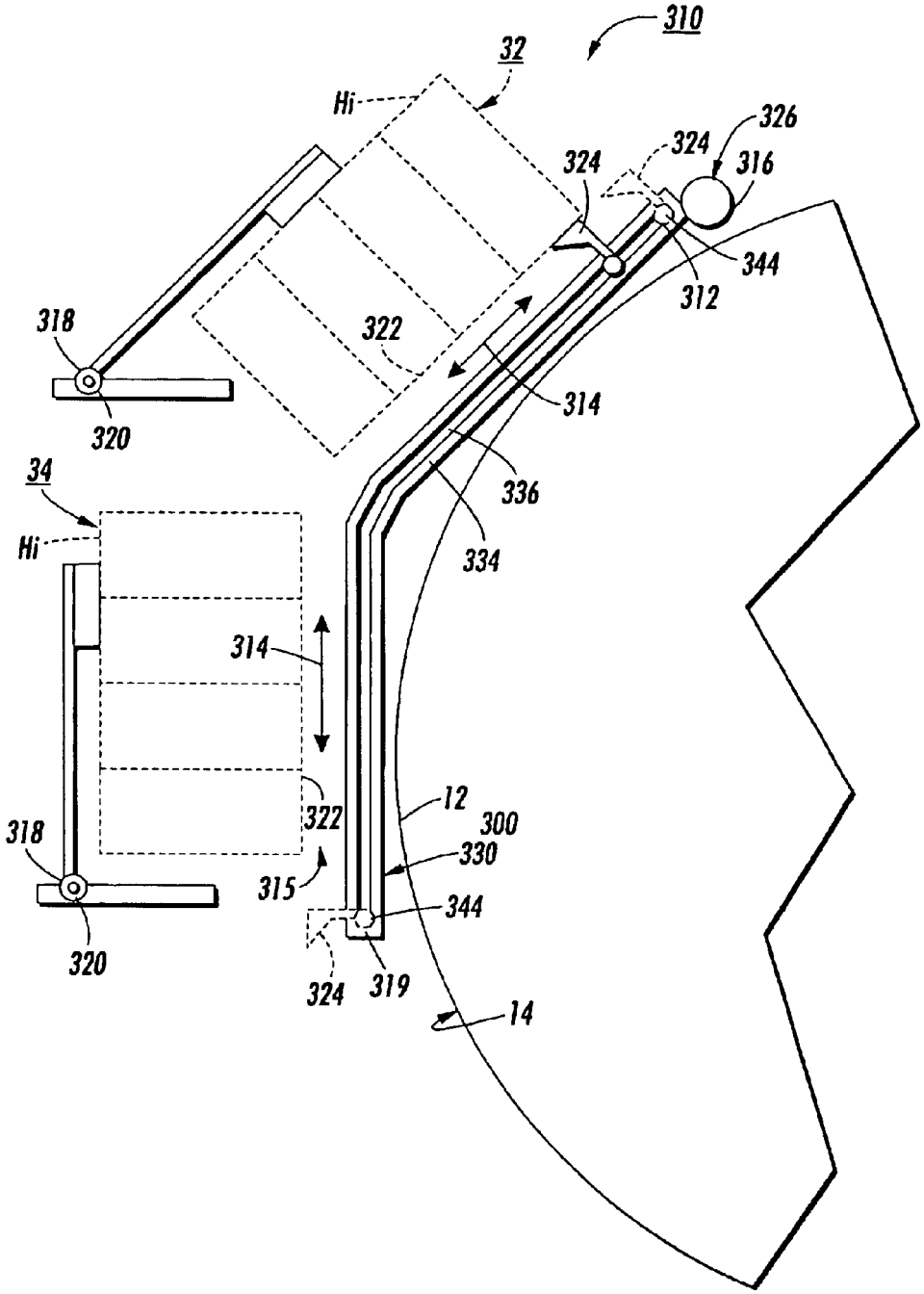
FIG. 3 is an enlarged end view illustration of the printhead interposing maintenance apparatus and method of FIG. 2 in accordance with the present invention.
Figure 4:
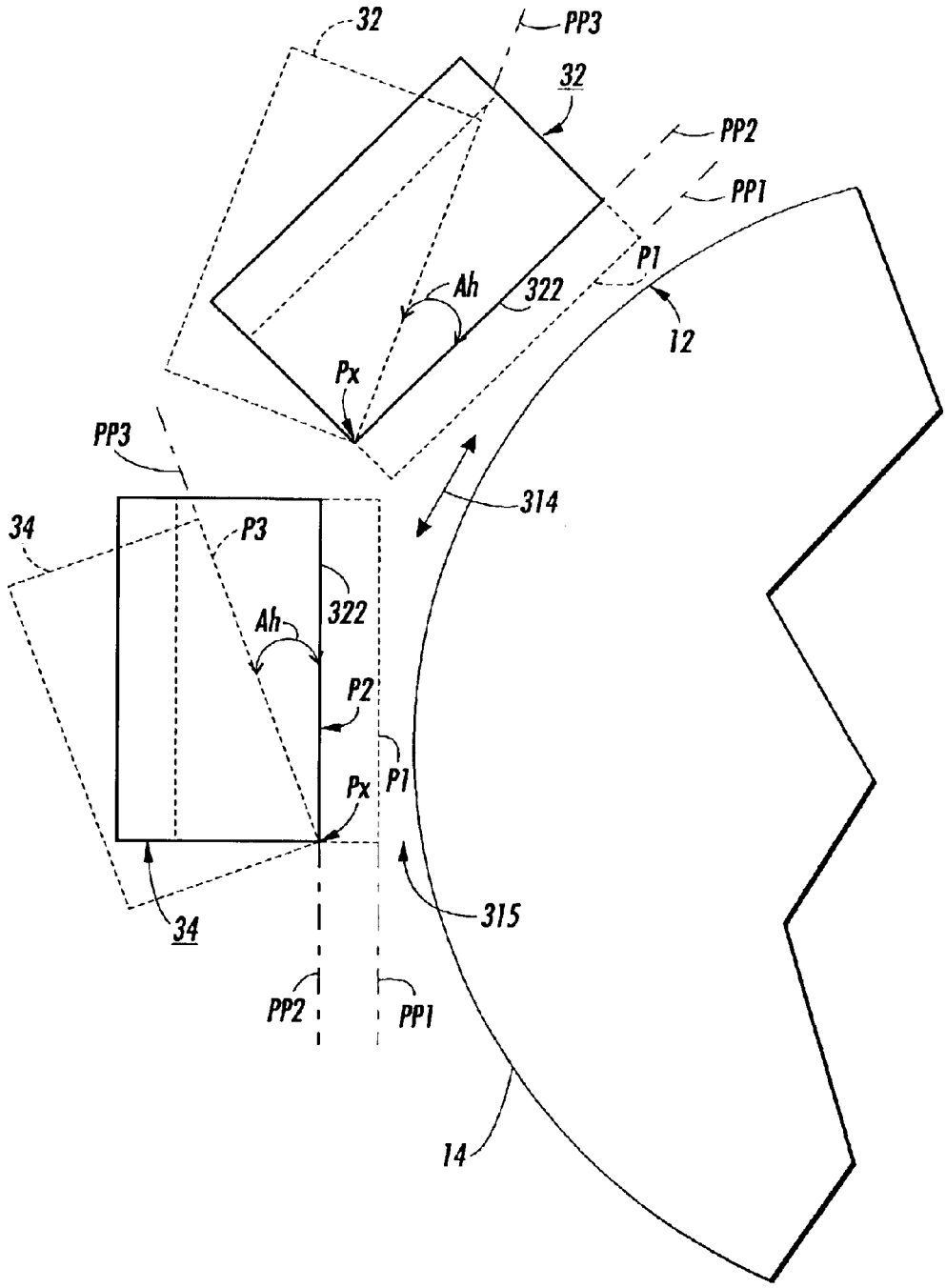
FIG. 4 is another enlarged end view illustration of the printhead interposing maintenance apparatus and method of FIG. 2 showing printhead movements between printing and maintenance positions in accordance with the present invention.

Referring now to FIGS. 1–3, the printhead interposing maintenance apparatus and method 300, 330 of the present invention is further illustrated in greater detail. The arrangement of printhead assemblies 36 and 38 in the color machine of FIG. 1 is a mirror image of that of printhead assemblies 32 and 34. The interposing arrangement of printhead interposing maintenance apparatus and method 330 is therefore also a mirror image of that of printhead interposing maintenance apparatus and method 300. Printhead interposing maintenance apparatus and method 300 is therefore identical to 330, and a description below of 300 will also suffice as a description of 330.

As shown, printhead interposing maintenance apparatus 300 of the present invention is suitable for maintaining a printhead assembly 32, 34 within a relatively tight space in an image producing machine 10. The printhead interposing maintenance apparatus 300 includes (a) a home position 312 adjacent a first side S1 of four sides S1–S4 of an operating (printing and cleaning) zone 315 between the printhead assembly 32, 34 and an imaging surface 14; (b) first moving means 316, such as a stepper motor and pulley assembly, for moving the printhead assembly 32, 34 from a printing first position P1 (adjacent the imaging surface 14) to a maintaining second position P2 that is spaced further away from the printing first position P1.

The printhead interposing maintenance apparatus 300 also includes (c) a maintenance device 310 that is movably supported for movement along a maintenance path 314 that is interposed between the imaging surface 14 and the printhead assembly 32, 34. The maintenance device 310 is movably supported on support brackets or end plates 334 each including a contoured slot 336 defining the maintenance path 314 for constantly spacing the cleaning blade 324 from the cylindrical imaging surface 14.

The printhead interposing maintenance apparatus 300 further includes (d) a second moving means 318, comprising a motor and pulley assembly for example, for moving the maintenance device 310 along the maintenance path 314 from the home position 312 to a resting position 319 that is adjacent a second side S2 opposite the first side SI. Such movement is suitable for contacting and maintaining the printhead assembly 32, 34, and (e) a third moving means 320, which may comprise the first moving means moving in reverse, for moving the printhead assembly 32, 34 back from the maintaining second position P2 to the printing first position P1.

In one embodiment as illustrated, the operating zone 315 lies in a generally an up and down orientation, and the home position 312 is adjacent the top side S1 of the four sides thereof. The printhead interposing maintenance apparatus 300 includes a fourth moving means, comprising for example the first moving means 316 and a cam assembly, for moving the printhead assembly 32, 34 from the maintaining second position P2 to a clearing third position P3 that is spaced further away from the maintaining second position P2. The fourth moving means (316) include means for pivoting each printhead Hi of the printhead assembly 32, 34 through an angle Ah about a pivot Px located at the maintaining second position P2 thereof.

The first moving means 316 is located and programmed so as to move a face 322 of each printhead Hi (H1–Hn) of the printhead assembly 32, 34 from a first plane PP1 at the printing first position P1 to a second and parallel plane PP2 at the maintaining second position P2. The maintenance device 310 for example includes a printhead face wiper blade 324 for contacting and wiping each face 322 of each printhead Hi of the printhead assembly 32, 34.

The printhead interposing maintenance apparatus 300 includes aligning means 326 such as the first moving means 316 and belt and pulley assemblies, for aligning the plural printheads Hi (H1–Hn) of the printhead assembly 32, 34 for single pass maintenance by the maintenance device 310. It also includes purging means 308 including the controller 80 and a gutter 313 for controllably purging marking material such molten liquid ink from each printhead Hi of the printhead assembly 32, 34. It further includes heating means 332 for heating each printhead Hi of the printhead assembly 32, 34 to a desired temperature, and a waste container 317 for receiving waste marking material removed from the printheads by the cleaning or wiper blades 324.

Specifically, as shown multiple printhead assemblies 32, 34, 36, 38 are oriented around a drum imaging member 12, thereby causing the faces 322 of the printheads Hi–Hn of each printhead assembly to be at a different angle to each other as shown. In according to the present invention, the angled faces 322 are simultaneously wiped clean with one motion of the interposing maintenance apparatus 310. This is done in order to minimize the wiper time required and as well as to use one motion control. As illustrated, both angled faces 322 (upper and lower) for each group of printheads in a printhead assembly are wiped at the same time by the cleaning blades 324 using one motor drive. The wiper blades 324 are mounted to support members or trucks 340 that are connected together with a link 344. The link 344 has ends that run through contoured or angled slots 336 in opposite end plates or brackets 334. In operation, the first truck 340 will follow the upper head angle and turn between the heads and follow the lower head angle. The trucks are pulled by a pulley and belt mounted on the truck.

Each slot 336 is contoured in order to constantly space the wiper blades 324 from the imaging surface 14. As such, each slot makes a bend between the upper and lower printheads. Two trucks are linked together to create a train with wipers mounted on the trucks. The trucks or support members have the home position 312 that is also the starting cleaning position at the top S1 of an operating zone 315. When the wiping starts, both trucks are pulled through their appropriate motion for wiping both heads simultaneously.

The method of the present invention includes (a) locating a movable maintenance apparatus 300 in a home position 314 adjacent a first side S1 of four sides S1–S4 of an operating zone 315 between the printhead assembly 32, 34 and the imaging surface 14. It then includes (b) first moving the printhead assembly from a printing first position P1 adjacent the imaging surface to a maintaining second position P2 spaced further away from the printing first position; and (c) moving the maintenance apparatus from the home position 314 to a resting position adjacent a second and opposite side S2 of the four sides for contacting and maintaining the printhead assembly; and (d) then moving the printhead assembly back from the maintaining second position P2 to the printing first position P1.

According to an aspect of the method, before moving the printhead assembly back to the printing position P1, it is moved from the maintaining second position P2 to a clearing third position P3 that is spaced further away from the maintaining second position P2. This is followed by moving the maintenance device 310 from the resting position 319 back along the maintenance path 314 to the home position 312 without interference contact with the printhead assembly.

The method includes controllably purging marking material from each printhead of the printhead assembly before moving the maintenance apparatus from the home position, and heating each printhead of the printhead assembly to a desired temperature before controllably purging marking material from the each printhead. It also includes moving the printhead assembly from the maintaining second position to a clearing third position comprises moving a first end of each printhead of the printhead assembly about a pivot on a second end of the each printhead at the maintaining second position.

As can be seen, there has been provided a printhead interposing maintenance method and apparatus are provided for maintaining a printhead assembly within a relatively tight space in an image producing machine. The printhead interposing maintenance apparatus for the method includes (a) at least a first home position adjacent a first side of four sides of an operating zone between a printhead assembly and an imaging surface in the image producing machine; (b) a first moving device for moving the printhead assembly from a printing first position adjacent the imaging surface to a maintaining second position spaced further away from the printing first position; (c) a maintenance apparatus movably supported for movement along an maintenance path interposed between the imaging surface and the printhead assembly; (d) a second moving device for moving the maintenance apparatus for contacting and maintaining the printhead assembly, and along the maintenance path from the at least first home position to a resting position adjacent a second side and opposite the first side of the four sides of the operating zone; and (e) a third moving device for moving the printhead assembly back from the maintaining second position to the printing first position.

While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. A printhead interposing maintenance method for cleaning a printhead assembly within a relatively tight space in an image producing machine, the printhead interposing maintenance method comprising:

(a) locating a movable maintenance apparatus in a home position adjacent a first side of four sides of an operating zone between said printhead assembly and an imaging surface in the image producing machine;

(b) first moving said printhead assembly from a printing first position adjacent said imaging surface to a maintaining second position spaced further away from said printing first position;

(c) moving said maintenance apparatus from said home position adjacent said first side along a maintenance path interposed between said imaging surface and said printhead assembly to a resting position adjacent a second and opposite side of said first side of said four sides of said operating zone for contacting and maintaining said printhead assembly;

(d) moving said printhead assembly from said maintaining second position to a clearing third position spaced further away from said maintaining second position;

(e) moving said maintenance apparatus from said resting position back along said maintenance path to said home position without interference contact with said printhead assembly; and (f) then moving said printhead assembly back from said maintaining second position to said printing first position adjacent said imaging surface.

2. The method of claim 1, wherein said operating zone lies within a generally vertical plane and said home position is adjacent a top side of said four sides thereof.

3. The method of claim 1, wherein first moving said printhead assembly comprises moving a face of a printhead of said printhead assembly from a first plane at said printing first position to a second and parallel plane at said maintaining second position.

4. The method of claim 1, wherein said maintenance apparatus includes a printhead face wiper blade, and wherein maintaining said printhead assembly comprises wiping a face of a printhead of said printhead assembly with said printhead face wiper blade.

5. The method of claim 1, wherein said printhead assembly includes plural printheads and the method includes aligning said plural printheads for single pass maintaining by said maintenance apparatus.

6. The method of claim 1, including controllably purging marking material from each printhead of said printhead assembly before moving said maintenance apparatus from said home position.

7. The method of claim 6, including heating each printhead of said printhead assembly to a desired temperature before controllably purging marking material from said each printhead.

8. The method of claim 1, wherein said imaging surface is a cylindrical surface and moving said maintenance apparatus from said home position comprises moving a printhead wiper blade support member through contoured slots formed to constantly space said printhead wiper blade from said imaging surface.

9. The method of claim 1, wherein moving said printhead assembly from said maintaining second position to a clearing third position comprises pivoting each printhead of said printhead assembly about a pivot at said maintaining second position.

10. A printhead interposing maintenance apparatus for maintaining a printhead assembly within a relatively tight space in an image producing machine, the printhead interposing maintenance apparatus comprising:

(a) at least a first home position adjacent a first side of four sides of an operating zone between a printhead assembly and an imaging surface in the image producing machine;

(b) first moving means for moving the printhead assembly from a printing first position adjacent the imaging surface to a maintaining second position spaced further away from said printing first position;

(c) a maintenance apparatus movably supported for movement along a maintenance path interposed between the imaging surface and the printhead assembly;

(d) a second moving means for moving said maintenance apparatus for contacting and maintaining said printhead assembly, and along said maintenance path from said at least first home position to a resting position adjacent a second side and opposite said first side of said four sides of said operating zone;

(e) a third moving means for moving said printhead assembly back from said maintaining second position to said printing first position; and (f) a fourth means for moving said printhead assembly from said maintaining second position to a clearing third position spaced further away from said maintaining second position.

11. The printhead interposing maintenance apparatus of claim 10, wherein said operating zone lies within a generally vertical plane and said home position is adjacent a top side of said four sides thereof.

12. The printhead interposing maintenance apparatus of claim 10, wherein said first moving means moves a face of each printhead of said printhead assembly from a first plane at said printing first position to a second and parallel plane at said maintaining second position.

13. The printhead interposing maintenance apparatus of claim 10, wherein said maintenance apparatus includes a printhead face wiper blade for contacting and wiping each face of each printhead of said printhead assembly.

14. The printhead interposing maintenance apparatus of claim 10, including aligning means for aligning plural printheads of said printhead assembly for single pass maintaining by said maintenance apparatus.

15. The printhead interposing maintenance apparatus of claim 10, including purging means for controllably purging marking material from each printhead of said printhead assembly.

16. The printhead interposing maintenance apparatus of claim 15, including heating means for heating each printhead of said printhead assembly to a desired temperature.

17. The printhead interposing maintenance apparatus of claim 10, including contoured support means defining a maintenance path for constantly spacing said maintenance apparatus from said imaging surface.

18. The printhead interposing maintenance apparatus of claim 10, wherein said third moving means comprise means for pivoting each printhead of said printhead assembly about a pivot located at said maintaining second position thereof.

19. An image producing machine comprising:

(a) a control subsystem for controlling operation of all subsystems and components of the image producing machine;

(b) a movable imaging member having an imaging surface;

(c) a printhead assembly including plural printheads each connected to said control subsystem and having a face for ejecting drops of liquid phase change ink onto said imaging surface to form an image; and (d) a printhead interposing maintenance apparatus for maintaining a printhead assembly within a relatively tight space, the printhead interposing maintenance apparatus comprising:

(i) at least a first home position adjacent a first side of four sides of an operating zone between the printhead assembly and said imaging surface;

(ii) first moving means for moving said printhead assembly from a printing first position adjacent said imaging surface to a maintaining second position spaced further away from said printing first position;

(iii) a maintenance apparatus movably supported for movement along a maintenance path interposed between said imaging surface and said printhead assembly;

(iv) a second moving means for moving said maintenance apparatus for contacting and maintaining said printhead assembly, and along said maintenance path from said at least first home position to a resting position adjacent a second side opposite said first side of said four sides of said operating zone;

(v) a third moving means for moving said printhead assembly back from said maintaining second position to said printing first position; and (vi) contoured support means defining a maintenance path for constantly spacing said maintenance apparatus from said imaging surface.

20. The image producing machine of claim 19, including purging means for controllably purging marking material from each printhead of said printhead assembly.

21. A phase change ink image producing machine comprising:

(a) a control subsystem for controlling operation of all subsystems and components of the image producing machine;

(b) a movable cylindrical imaging member having a cylindrical imaging surface;

(c) a printhead assembly including plural printheads each connected to said control subsystem and having a face for ejecting drops of molten liquid phase change ink onto said imaging surface to form an image; and (d) a printhead interposing maintenance apparatus for maintaining a printhead assembly within a relatively tight space, the printhead interposing maintenance apparatus comprising:

(i) a home position adjacent a first side of four sides of an operating zone between the printhead assembly and said cylindrical imaging surface;

(ii) first moving means for moving said printhead assembly between a printing first position adjacent said cylindrical imaging surface and a maintaining second position spaced further away from said printing first position;

(iii) a maintenance apparatus including a cleaning blade for moving along a maintenance path interposed between said imaging surface and said printhead assembly;

(iv) support brackets each including a contoured slot defining a maintenance path for constantly spacing said cleaning blade from said cylindrical imaging surface; and (v) a second moving means for moving said cleaning blade and said maintenance apparatus along said maintenance path from said at least first home position to a resting position adjacent a second side opposite said first side of said four sides of said operating zone for contacting and cleaning printheads of said printhead assembly.

22. The image producing machine of claim 21, including a gutter for receiving waste marking material removed from said printheads by said cleaning blade.

* * * * *